US006724356B1

(12) United States Patent
Kojima et al.

(10) Patent No.: US 6,724,356 B1
(45) Date of Patent: Apr. 20, 2004

(54) PLASMA DISPLAY UNIT

(75) Inventors: Ayahito Kojima, Kawasaki (JP); Hiroyuki Wakayama, Kawasaki (JP); Hirohito Kuriyama, Kawasaki (JP); Katsuhiro Ishida, Kawasaki (JP); Akira Yamamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/537,757

(22) Filed: Mar. 30, 2000

(30) Foreign Application Priority Data

Jun. 30, 1999 (JP) ..... 11-185468

(51) Int. Cl.[7] ..... G09G 3/28

(52) U.S. Cl. ..... 345/60; 345/63; 345/68; 345/211

(58) Field of Search ..... 345/60, 61, 63, 345/68, 211

(56) References Cited

U.S. PATENT DOCUMENTS 5,943,032 A 8/1999 Nagaoka et al.
5,956,014 A 9/1999 Kuriyama et al.
6,100,859 A * 8/2000 Kuriyama et al. ..... 345/60

FOREIGN PATENT DOCUMENTS

EP 0 653 740 A2 5/1995
EP 0 841 652 A1 5/1998
JP 7-140928 6/1995
JP 9-185343 7/1997
WO 99-30309 6/1999

OTHER PUBLICATIONS

Partial computer translation of JP09–185343.*

* cited by examiner

*Primary Examiner*—Dennis-Doon Chow
(74) *Attorney, Agent, or Firm*—Staas & Halsey LLP

(57) ABSTRACT

In a PDP unit, a display frame for one screen comprises a plurality of sub-frames, the luminance of each of which is determined by a sustaining pulse number. A length of one frame is calculated from the length of one cycle of a vertical synchronization signal and a sub-frame condition determination circuit determines, from the length of one frame, the number of sub-frames, the luminance of each sub-frame and a total sustaining pulse number. A load factor is calculated from an external input signal. A further circuit determines a maximum display luminance from consumed power and calculates a luminance factor, and yet a further circuit corrects the luminance drop due to a load from the total sustaining pulse number, the luminance ratio and the load factor for the respective sub-frame and calculates sustaining pulse numbers for the respective sub-frames. Thereby, the sustaining pulse numbers of the respective sub-frames are determined through calculations using the total sustaining pulse number, the luminance ratio, the load factor and the consumed power rather than using a luminance table, simplifying construction of the PDP unit while performing more accurate calculations and thereby improving display quality and providing a stable display without flickering.

6 Claims, 9 Drawing Sheets

| TOTAL SUSTAINING PULSE NUMBER | SUSTAINING PULSE NUMBERS OF RESPECTIVE SF | | | | |
|---|---|---|---|---|---|
| | SF1 | SF2 | SF3 | SF4 | SF5 |
| 31 | 1 | 2 | 4 | 8 | 16 |
| 93 | 3 | 6 | 12 | 24 | 48 |
| 158 | 5 | 11 | 21 | 40 | 81 |
| 248 | 8 | 16 | 32 | 64 | 128 |
| 312 | 10 | 21 | 40 | 81 | 160 |

PLASMA DISPLAY UNIT

BACKGROUND OF THE INVENTION

The present invention relates to a display unit (hereinafter, referred to as a plasma display unit (PDP unit)) using a plasma display panel (hereinafter, referred to as a PDP), and more particularly to a plasma display unit for displaying gradation by making the display luminescence time different by weighting every sub-frame.

In recent years, in display units, there have been growing demands for thinner units, increases of varieties of information to be displayed and installation conditions, larger screens and better resolution, and display units are required which can meet these demands. PDP units are display units which can handle these demands. In the PDP units, when displaying gradation, in general, a display frame is constituted by a plurality of sub-frames, the respective sub-frame periods are weighted so that they are differentiated, and the respective bits of gradation data are displayed by the corresponding subframes.

The PDP has a memory effect, and each cell is set for a state conforming to the display data. Luminescence for display (display luminescence) is effected by application of an AC voltage. As will be described later, this display luminescence intensity is varied by the number of the cells which are illuminated, and there is a problem in that the luminance ratio between the subframes deviates. In addition, consumed current and power also vary in accordance with the number of the cells which are illuminated. The present invention solves the problem entailed by the variation in display.

Regarding PDP types, there are two-electrode type PDPs in which selected discharge (address discharge) and maintained discharge (discharge for display luminescence) are carried out with two electrodes and a three-electrode type PDP in which a third electrode is used to carry out address discharge. Three-electrode type PDP units are disclosed in Japanese Unexamined Patent Publication (Kokai) Nos. 7-140928 and 9-185343, and therefore, a detailed description thereof will be omitted here and only the basic construction and operation thereof will be briefly described below.

FIG. 1 shows the basic construction of the three-electrode type PDP units. As shown therein, connected to a plasma display panel (PDP) 1 are an address driver 2 for outputting a signal to be applied to an address electrode, a Y scan driver 3 for outputting a signal to be applied to a scan electrode (Y electrode), an X common driver 4 for outputting a signal to be applied to a common sustaining discharge electrode (X electrode), and a Y common driver 5 for outputting a sustaining discharge signal to be applied to the Y electrode via the Y scan driver 3. A control circuit 6 has a display data control part 7 for generating from a display data inputted from the outside a display data signal to be outputted to the address driver 2 and a panel driving control part 8 for outputting a signal other than the display data which is related to the driving of the panel. The panel driving control part 8 has a scan driver control part 9 for generating a control signal which is related to a scan to be outputted to the Y scan driver 3 and a common driver control part 10 for generating a control signal related to the sustaining discharge.

FIG. 2 shows a frame construction for carrying out a 32-gradation display.

A gradation display in the PDP unit is generally carried out by making each bit of the display data correspond to the sub-frame time and changing the length of the sub-frame period in accordance with the weighting of the bits. For instance, when the 32-gradation display is carried out, the display data is represented by five bits, the display of one frame is constituted by five sub-frames SF1 to SF5, and the display of the respective bit data is carried out within the respective sub-frame periods. In reality, in order to control timings, there are provided rest periods when no operation is performed.

Each of the sub-frames SF1 to SF5 comprises a reset period during which all display cells of the panel are put in a uniform state, an addressing period during which wall electric charges corresponding to display data are accumulated in display cells, and a sustaining period during which a discharge for display is carried out by the display cells in which wall electric charges are accumulated by applying a sustaining discharge signal. As shown in FIG. 2, the respective lengths of the reset period and the addressing period are the same over the successive sub-frames, but the sustaining period is different. The respective lengths of the reset period and the address period of the successive sub-frames are identical. As described above, when the 32-gradation display is carried out, in general, the ratios between the respective lengths of the sustaining discharge periods becomes 1:2:4:8:16. The differences in luminance of 32 gradations from 0 to 31 can be displayed by selecting a combination of sub-frames to be illuminated in each display cell.

FIG. 3 is a block diagram showing a schematic construction of a part of a control circuit 6' related to the control circuit 6' of the present invention. Of the external input signals, the display data is inputted into a data converter 11 and a vertical synchronization signal (VSYNC) is inputted into a frame counter 12. The display data that is supplied from the outside (i.e., the external display data) generally takes a format in which gradation data of respective pixels are continuous, and they cannot be converted into the format of the sub-frames as they are. To cope with this, the data converter 11 temporarily stores the display data in the frame memory and then converts it into a format for the address data to be outputted to the address driver 2. Furthermore, the data converter calculates a load factor, which will be described later.

The frame counter 12 detects the length of one frame (frame length) from the vertical synchronization signal. There are various types of signals that are inputted from the outside, and it is generally true that PDP units are designed to deal with those signals by changing the control timing based on the frame length detected by the frame counter 12. The number of sub-frames (SF number) and the luminance ratio of each thereof are stored in a driving table 17 for a memory (ROM) 16 in accordance with the frame length. An arithmetic unit 13 calculates an address CASE of the memory 16 in which corresponding information is stored, based on the frame length, applies the CASE so calculated on the memory 16 via a scan controller 15 and determines an SF number and a luminance ratio corresponding to the frame length.

The arithmetic unit 13 decreases a time required for the reset period and the addressing period from the SF number, calculates a sustaining discharge period in one frame and calculates a total sustaining pulse number for one frame from the sustaining discharge period and one predetermined sustaining pulse cycle. Sustaining pulse numbers of the respective sub-frames are stored in a luminance table 19 of a memory (ROM) 18 in accordance with the total sustaining pulse number and the luminance ratio. The arithmetic unit 13 calculates from the total sustaining pulse number an address MCB of the memory 18 in which corresponding information is stored, applies the address MCB so calculated together with the luminance ratio on the memory 18 and determines sustaining pulse numbers for the respective sub-frames. Conventionally, the respective sustaining numbers of the successive sub-frames are determined for control. FIG. 4 shows an example of the luminance table 19.

Next, the load factor and the consumed power will be described. The effective brightness of the display by the sub-frames of each frame is determined by the respective luminance and period of the sustaining discharge in each of the subframes. The sustaining discharge periods of the respective sub-frames have a predetermined ratio (luminance ratio) and, if the number (display load) of display cells that are illuminated at the respective sub-frames is identical, the luminance by the sustaining discharge becomes identical, and the brightness of display has a predetermined ratio which is identical to the ratio of the sustaining discharge period. However, the currents supplied to the X electrode and Y electrode become different in response to the number of display cells which are illuminated simultaneously, and when current values are different, there is caused a voltage drop, due to distribution resistance, this resulting in a different luminescence intensity (luminance) even if sustaining discharges are identical. Specifically speaking, if there is a large number of display cells to be illuminated, in other words, when the load factor is large, the luminance becomes low, while if there are only a few display cells to be illuminated, in other words, when the load factor is small, the luminance becomes high. Due to this, when the load factor becomes different among the respective sub-frames, there is caused a difference between a luminance ratio that is actually obtained and a preset luminance ratio, the gradation which is displayed by a combination of the sub-frames cannot be displayed accurately, and in a worse case, there is caused a problem that there occurs an inversion in brightness between gradations.

With a view to solving the aforesaid problem, in the above-described invention disclosed in Japanese Unexamined Patent (Kokai) Publication No. 9-185343, a plurality of sustaining pulse numbers, that will result in a predetermined luminance, are stored for the respective sub-frames in accordance with the load factors, and the sustaining pulse number is determined by the sustaining pulse numbers in accordance with the load factors calculated by the data converter 11, whereby the luminance ratios of the respective sub-frames are maintained constant irrespective of load factors.

The large power consumption by the PDP unit is related to sustaining discharge. As described above, the currents supplied to the X electrodes and Y electrodes during a sustaining discharge depend on the number of display cells that are illuminated. Therefore, a value is related to the consumed power which is obtained by multiplying the respective load factors of the plural sub-frames by the respective lengths of the corresponding sustaining discharge periods thereof. In the PDP unit, an upper limit is provided for the consumed power (current), and a display is required which is as bright as possible within the range. To cope with this, the consumed power is detected, and if the consumed power does not exceed the upper limit, the total sustaining pulse number is increased to as high as possible within the range. Due to this, for example, if the display is bright, although the number of display cells that is illuminated is increased, the total sustaining pulse number is decreased, and therefore the consumed power falls within the range. On the contrary, if the display is not bright, the number of display cells that is illuminated is decreased and therefore the total sustaining pulse number is increased. Thus, the actual display does not become too dark, and the decrease in consumed power is not large. Even with a display like this, no feeling of physical disorder is sensed by any of the users.

A current detection circuit 14 shown in FIG. 3 is a circuit for detecting current flowing into the unit, and the consumed power is calculated from the detected current and the consumed power so calculated is then outputted to the arithmetic unit 13. The arithmetic unit 13 corrects the sustaining pulse numbers of the respective sub-frames read out of the luminance table 19 in accordance with the consumed power and outputs respective, corrected sustaining pulse numbers for the plural sub-frames to the scan controller 15. The scan controller 15 outputs signals for controlling the X common driver 4 and Y common driver 5 such that sustaining discharges can be carried out a number of times corresponding to the corrected sustaining pulse numbers during the corresponding sustaining discharge periods for the respective sub-frames.

As described above, the consumed power depends on the number of display cells that are illuminated. Therefore, the consumed power corresponds to a weighted mean value resulting from average weighting of the load factors of the respective sub-frames depending on the length of the sustaining discharge periods thereof. Consequently, instead of detecting current directly flowing into the unit, a weighted mean value resulting from average weighting of the load factors of the respective sub-frames, depending on the length of the sustaining discharge period thereof, is sometimes calculated for achieving an estimation of the consumed power, and the above-mentioned correction is carried out based on the estimated consumed power.

As shown in FIG. 3, the relationship, between the total sustaining pulse numbers and the sustaining pulse numbers of the respective sub-frames, is stored in advance in the luminance table 19 of the memory 18, and the aforesaid correction in response to the consumed power is carried out for the respective sustaining pulse numbers of the sub-frames read out of the luminance table 19. This causes a problem that a large-scale memory (ROM) is required in order to prepare an accurate luminance table.

In addition, the values stored in the luminance table 19 are, as shown in FIG. 4, positive integers, and values below the decimal point are rounded to the nearest whole number. Due to this, stored values include round-off errors. When the aforesaid correction is carried out for the sustaining pulse number, there is caused a problem in that the error is increased and the predetermined luminance cannot be obtained. Of course, it is possible to conceive of expanding the capacity of the memory 18 so as to make the luminance table 19 more accurate, but in this case, too, there occurs a problem in that a memory 18 of large capacity has to be used.

In addition, in the conventional PDP unit, the respective load factors of the plural sub-frames are calculated for each frame so as to determine corresponding sustaining pulse numbers for the plural sub-frames. In addition, corrections are carried out in accordance with the consumed power, and the sustaining discharges are controlled in accordance with the corrected sustaining pulse numbers so obtained. Due to this, there is caused a problem that the respective sustaining pulse numbers of the plural sub-frames vary for each frame and this causing flickering.

FIG. 5 is a graph showing variations in the load factor during display. As shown in the figure, small variations in load factor are found in ranges surrounded by a dotted line. For variations across different ranges, needless to say, corrections are needed in accordance with the luminance ratio and consumed power of the sub-frame but, in the PDP unit of FIGS. 3 and 4, corrections were carried out even in each of the ranges surrounded by the dotted line, and this caused flickering.

SUMMARY OF THE INVENTION

The present invention was made to solve the aforesaid problems, and an object thereof is to realize a PDP unit which does not need a memory for storing a luminance table, so as to simplify the construction thereof, which can perform more accurate operations so as to improve the display quality and can provide a stable display without flickering.

With a view to attaining the above object, according to a plasma display unit of the present invention, the respective sustaining pulse numbers of plural sub-frames of each frame are determined through an operation using a total sustaining pulse number, a luminance ratio, a load factor and the consumed power, rather than using a luminance table.

In other words, there is provided a frame time-sharing type plasma display unit in which a display frame for one screen is constituted by a plurality of subframes, and in which the respective luminance of each sub-frame is determined by a sustaining pulse number, the plasma display unit comprising a frame length calculation circuit for calculating the length of one frame from the length of one cycle of a vertical synchronization signal, a sub-frame condition determination circuit for determining, from the length of one frame, the number of sub-frames, the respective luminance of each sub-frame and a total sustaining pulse number, a load factor calculation circuit for calculating a load factor, which is a ratio of a number of display cells that are illuminated to a total number of display cells, from an external input signal, a luminance factor calculation circuit for determining a maximum display luminance from the consumed power and calculating a luminance factor and a sustaining pulse number calculation circuit for correcting the luminance drop due to load from the total sustaining pulse number, the luminance ratio and the load factor for the respective sub-frame and operating sustaining pulse number s for the respective sub-frames.

According to the present invention, the luminance table can be removed and the influence of round-off errors can be reduced.

BRIEF DESCRIPTION OF THE DRAWINGS

The feature and advantages of the invention will be more clearly understood from the following description taken in conjunction with the accompanying drawings in which.

DESCRIPTION OF THE PREFERRED EMBODIMENTS

Figure 1:
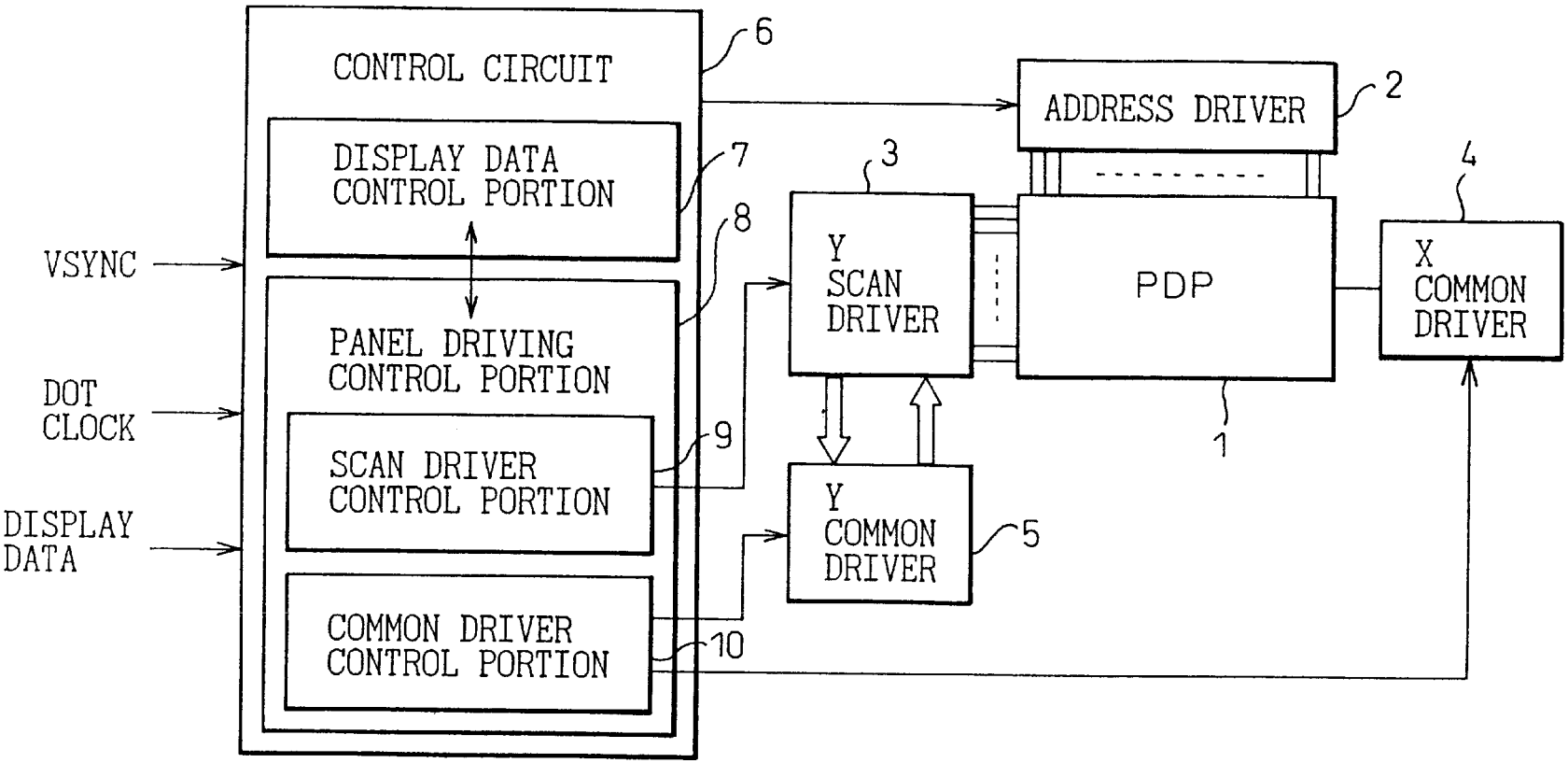
Fig.1 PRIOR ART
FIG. 1 is a block diagram showing the construction of a PDP (plasma display panel) unit.
Figure 2:
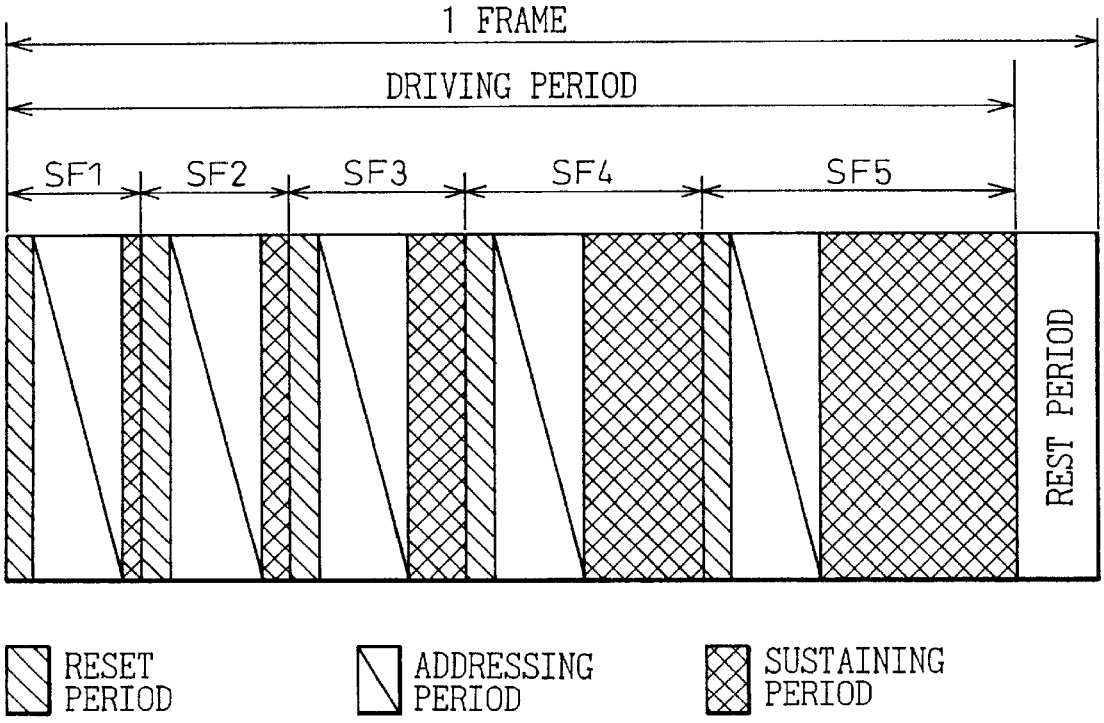
Fig.2 PRIOR ART
FIG. 2 is a diagram showing the construction of sub-frames for gradation display in the PDP unit.

A PDP unit according to the present invention has a construction such as shown in FIG. 1, and is different from a conventional unit only in part of a control circuit 6.

Figure 3:
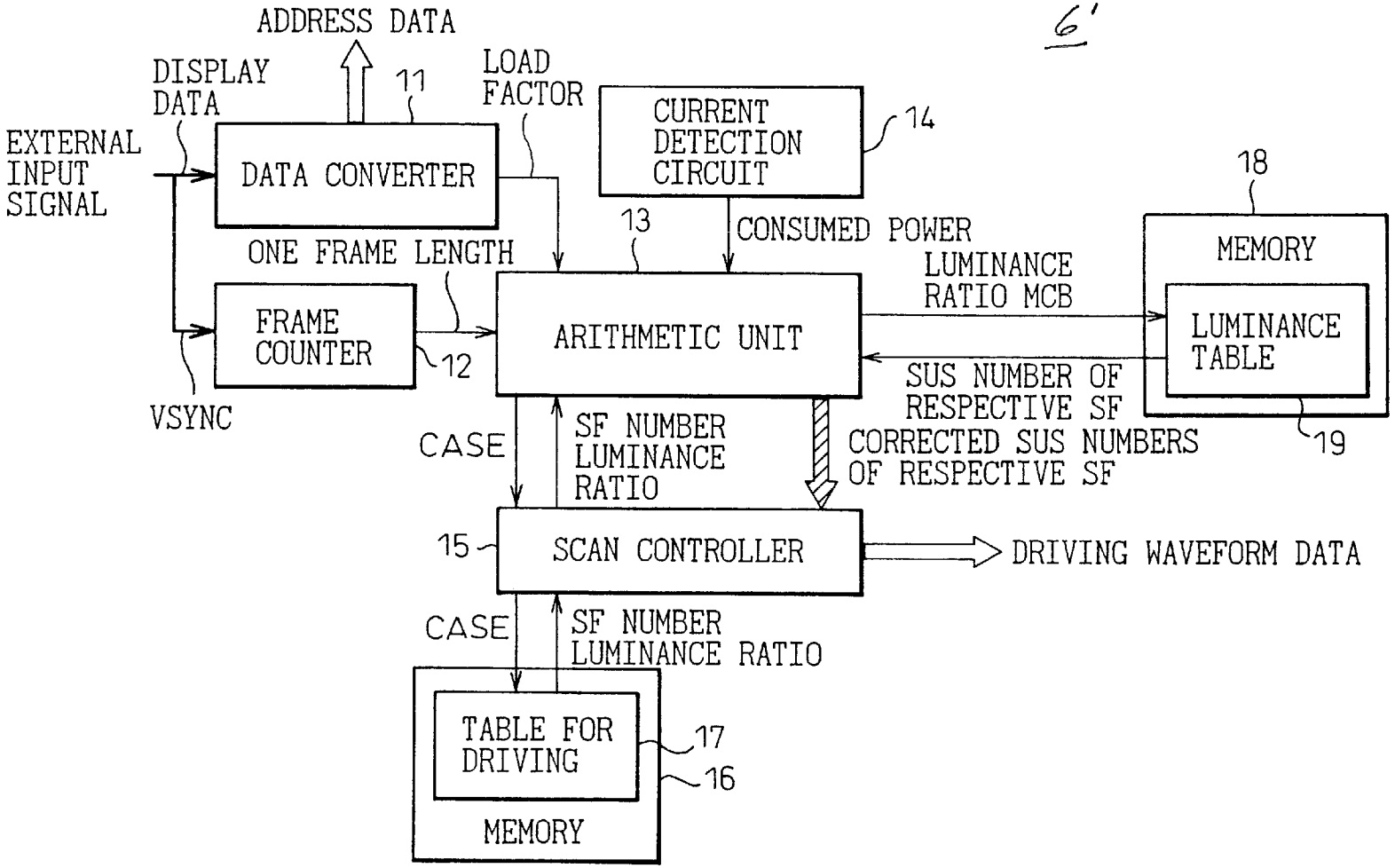
FIG. 3 is a diagram showing the schematic construction of a control circuit of a PDP u nit related to the present invention.
Figures 4, 5:
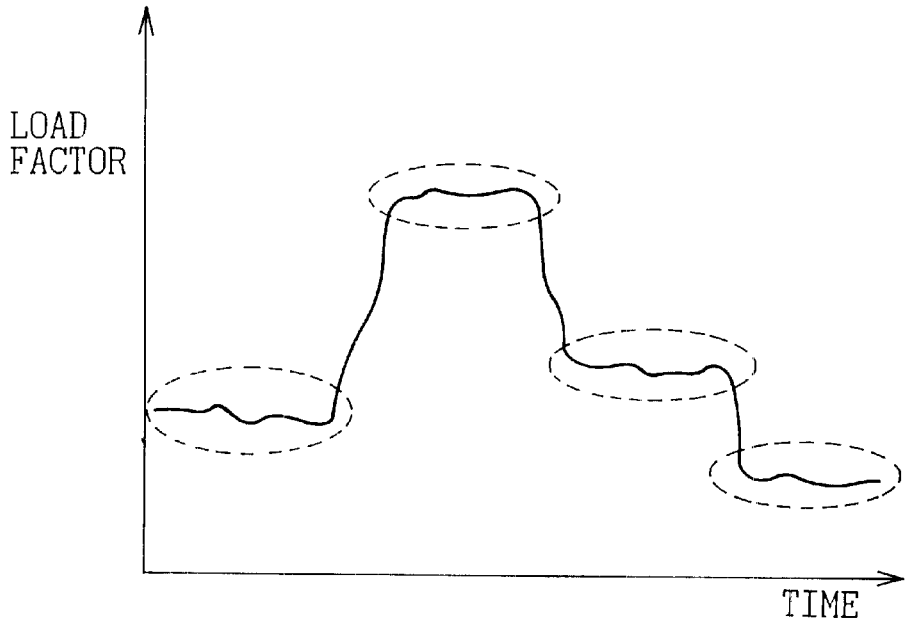
FIG. 4 is a diagram showing a luminance table for use in the circuit of FIG. 3.
FIG. 5 is a graph showing variations in load factor.
Figure 6:
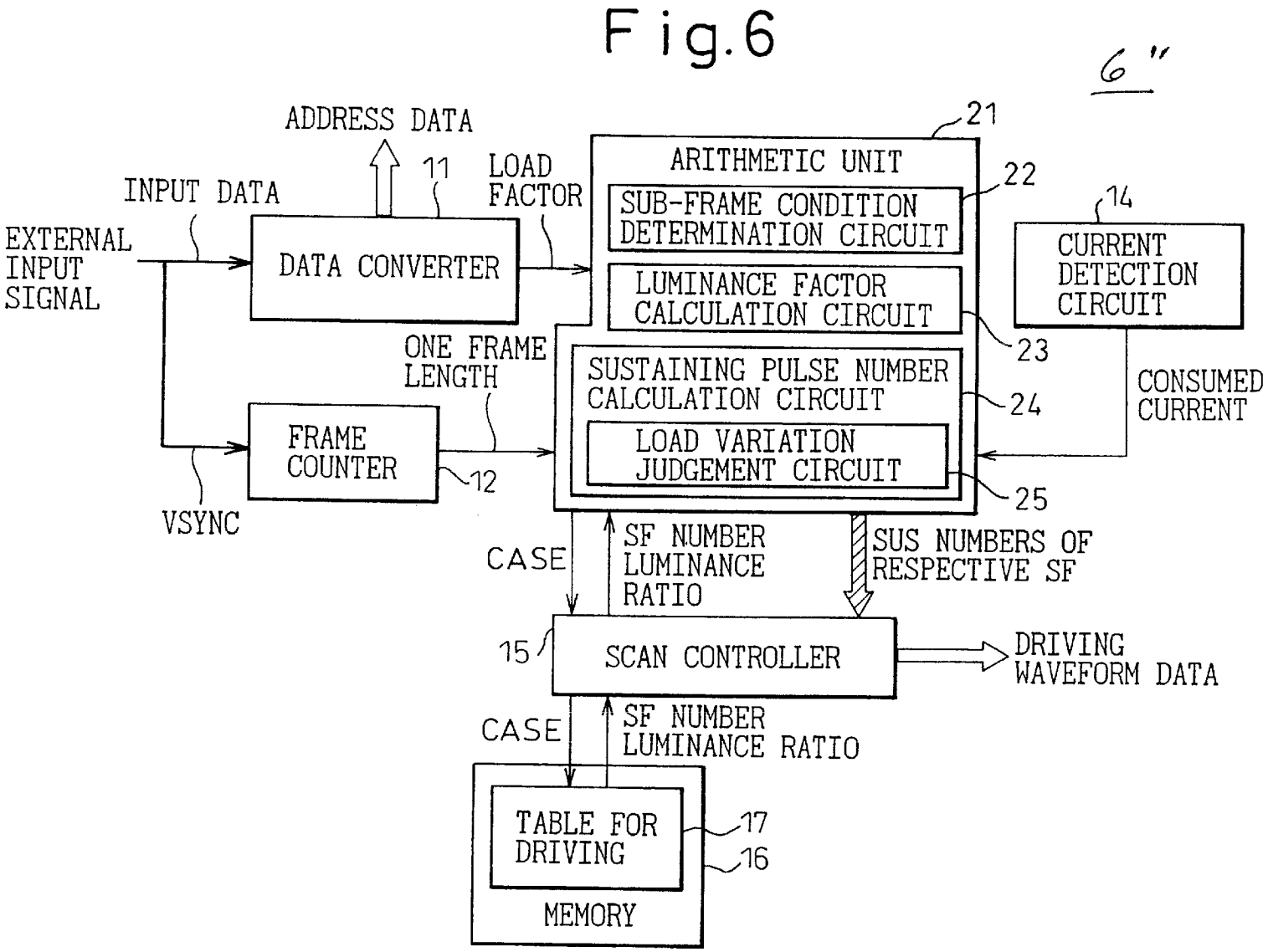
FIG. 6 is a diagram showing the construction of a control circuit of a PDP unit according to an embodiment of the present invention.

FIG. 6 is a block diagram showing the schematic construction of the control circuit 6" according to the embodiment of the present invention, and this figure corresponds to FIG. 3. As is clear when compared with FIG. 3, the control circuit 6" of the embodiment of the invention is different from the control circuit 6' in the example of FIG. 3 in that the memory 18 storing the luminance table 19 is removed and in that respective sustaining pulse numbers of the plural sub-frames of each frame are calculated by an arithmetic unit 21. The arithmetic unit 21 includes a sub-frame condition determination circuit 22, a luminance factor calculation circuit 22 and a sustaining pulse number calculation circuit 24. The sub-frame condition determination circuit 22 performs substantially the same processes as those done in the prior art. The circuits in the arithmetic unit 21 are realized by hardware or software.

The luminance factor calculation circuit 23 comprises a consumed power calculating circuit for calculating an estimated consumed power from the load factor to thereby determine a maximum display luminance in accordance with the consumed power and calculate a luminance factor. In this case, the load factor calculating circuit, or data converters 11, calculates the respective load factors for the sub-frames and the arithmetic unit 21 comprises a weighted mean load factor calculating circuit which calculates the weighted mean load factor from the respective load factors and respective luminance ratios for the plural sub-frames, the weighted mean load factor being regarded as the load factor.

The sustaining pulse number calculation circuit 24 comprises a load factor memory storing load factors, and a load factor variation calculating circuit 25 calculating a difference between the calculated load factor and the load factor of the previous frame stored in the load factor memory, wherein when the difference does not exceed a predetermined threshold value, the sustaining pulse numbers of the respective sub-frames are not calculated and the respective sustaining pulse numbers of the plural sub-frames in a previous frame are outputted as the respective sustaining pulse numbers for the plural sub-frames of the current frame, whereas when the difference exceeds the predetermined threshold value, calculated sustaining pulse numbers for the respective sub-frames are outputted.

With this construction, in a case where the variation in load factor is small, since the respective sustaining pulse numbers of the plural sub-frames do not change, a stable display, free from flickers can thus be provided.

In the above description, the luminance factor calculation circuit 23 estimates the consumed power from the load factor. However, a modification is possible in which the luminance factor calculation circuit 23 does not estimates the consumed power from the load factor. In the modification, the luminance factor calculation circuit 23 comprises a consumed power calculation circuit for detecting and calculating the consumed power of the unit from consumed current detected by the current detection circuit 14 and a comparison circuit for comparing the consumed power with a preset reference power, wherein when the consumed power exceeds the reference power, the luminance factor is decreased while, when the consumed power does not exceed the reference power, the luminance factor is increased.

In this case, too, the invention may be implemented such that when the variation is small, as with the previous case, the sustaining pulse numbers are maintained, and only when the variation is large, are the previous sustaining pulse numbers revised to the corrected sustaining pulse numbers.

Figure 7:
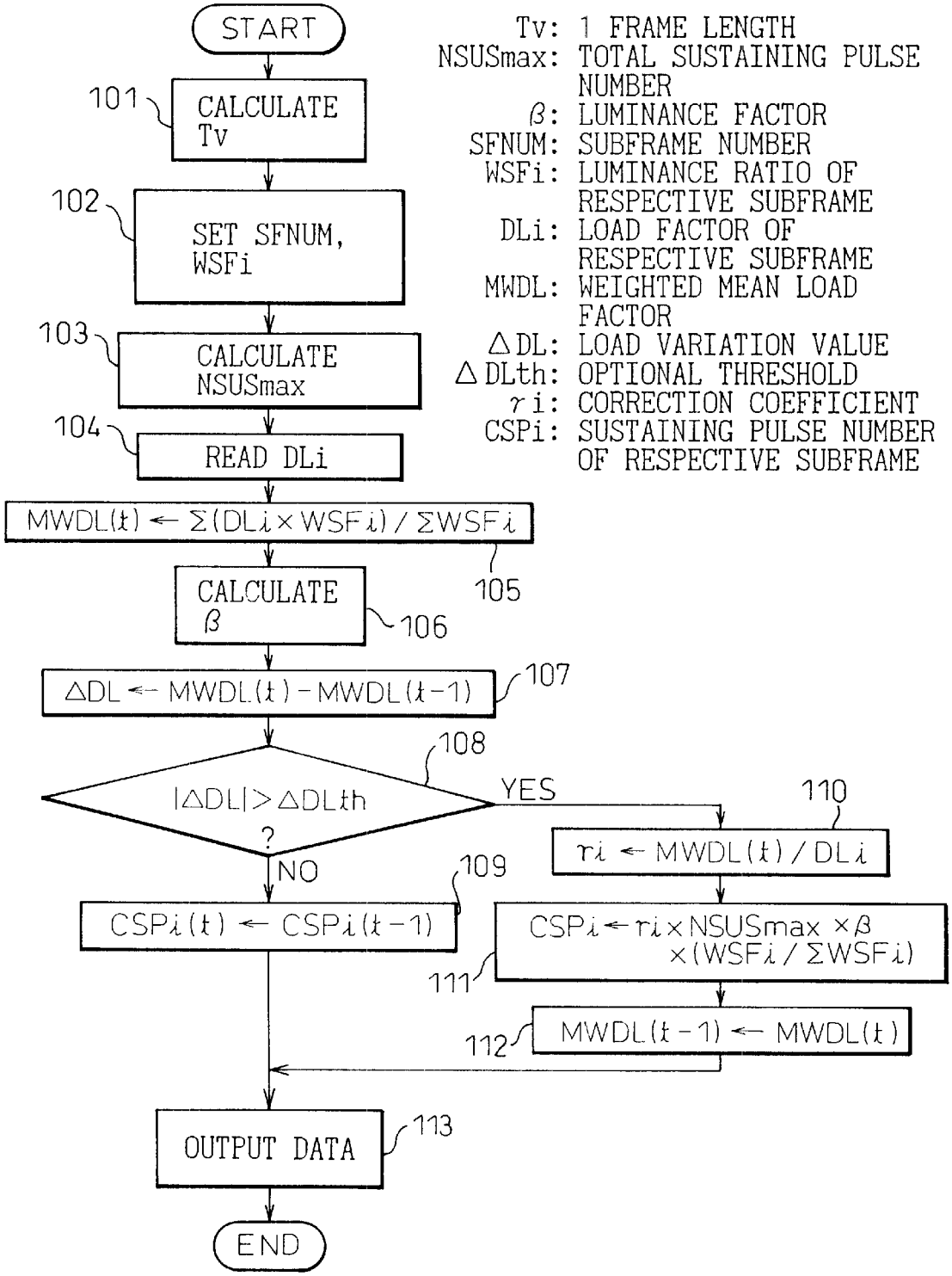
FIG. 7 is a flow chart showing a calculating process of sustaining pulse numbers for the respective sub-frames in the embodiment.

FIG. 7 is a flow chart showing calculation and correction processes of the respective sustaining pulse numbers of the sub-frames carried out by the control circuit 6". Referring to FIG. 7, the processes performed by the control circuit 6" will be described below.

In Step 101, as with the conventional example, a frame counter 12 detects the length of one frame (frame length) Tv from a vertical synchronization signal. In Step 102, the sub-frame condition determination circuit 22 of the arithmetic unit 21 calculates, based on the frame length Tv, an address CASE of a memory 16 in which corresponding information is stored, applies the calculated address CASE on the memory 16 via a scan controller 15 and determines an SF number (SFNUM) corresponding to the frame length Tv stored in a driving table 17 and luminance ratios (WSFi) of the respective sub-frames.

In Step 103, the sub-frame condition determination circuit 22 of the arithmetic unit 21 calculates a time DVT=SFNUM×(RT+AT) required by other than a sustaining discharge period (luminance display period) from SFNUM and times required for driving the PDP, such as a preset reset period (RT) and an address period (AT). A time ST=Tv−DVT for use for the sustaining discharge period is calculated from a difference between Tv and DVT. Furthermore, a total sustaining pulse number NSUSmax=ST/SPT is calculated from one sustaining pulse cycle SPT which is preset.

In Step 104, respective load factors Dli of the plural sub-frames, calculated by data converter 11, are read. In Step 105, the arithmetic unit 21 calculates a weighted mean load factor MWDL(t)=Σ(Dli×WSFi)/ΣWSFi from the respective load factors Dli and the respective luminance ratios WSfi of the respective sub-frames. The weighted mean load factors so calculated are then stored.

Figure 8:
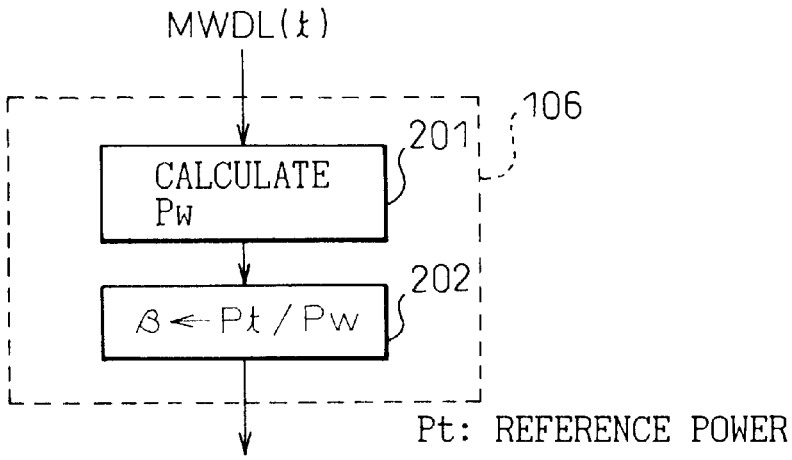
FIG. 8 is a flow chart showing a calculating process of a luminance factor β.

In Step 106, the luminance factor calculation circuit 23 calculates a β process as shown in FIG. 8.

In Step 201 of FIG. 8, an estimated consumed power Pw is calculated from the weighted mean load factor MWDL(t). According to the specific operating method, for instance, the relationship between the load factor and the consumed power is investigated in advance, an equation for calculating the consumed power from the load factor is stored in the arithmetic unit, and a calculation is carried out in accordance with the calculating equation so stored. In the simplest method, a product of power per unit load and the weighted mean load factor MWDL(t) is calculated. In Step 202, a luminance factor=Pt/Pw is calculated which is a ratio with a preset reference power Pt.

In Step 107, the sustaining pulse number calculation circuit 24 calculates a load variation value ΔDL=MWDL(t)−MWDL(t−1) from a difference between the weighted mean load factor MWDL(t−1) existing when the sustaining pulse numbers were set before storage and the MWDL(t) currently calculated. In Step 108, an absolute value of ΔDL and a preset threshold value ΔDLth are compared. The calculation and comparison in the Steps 107 and 108 are carried out by the load variation judgement circuit 25 in the sustaining pulse number calculation circuit 24.

In a case where the absolute value ΔDL is small, in Step 109, the respective sustaining pulse numbers CSPi(t−1) of the plural sub-frames of the previous frame are regarded as the respective sustaining pulse numbers CSPi(t) of the plural sub-frames of the current frame. In a case where the absolute value ΔDL is large, in Step 110, a correction coefficient yi=MWDL(t)/DLi is calculated from the calculated weighted mean load factor MWDL(t) and the load factor Dli.

In Step 111, the sustaining pulse numbers CSPi(t)=yi×NSUSmax×px(WSFi/ΣWSFi) are calculated from the correction coefficient yi, total sustaining pulse number NSUSmax, luminance ratio WSFi, luminance factor β. In Step 112, a weighted mean load factor MWDL(t−1) to be used in operation for the following frame is replaced with MWDL(t) currently calculated.

In Step 113, the sustaining pulse numbers CSPi(t), calculated as described above, are outputted.

Through the processes described above, when the load factors change moderately or they vary slightly, the luminance of the sub-frames does not change and flickering can be reduced. For example, in a case where the screen is scrolled within the same scene, normally, since ΔDL<2%, if ΔDLth=3%, the change in luminance resulting from correction can be suppressed within the same scene.

Moreover, the luminance table 19 used in the conventional construction is no longer used, and therefore the memory can be omitted. In addition, since the influence from the round-off errors can be reduced, the variation in luminance is reduced, thereby making it possible to improve the display quality.

In the β process performed in Step 106 above, the variation in load factor was judged using the consumed power Pw estimated from the weighted mean load factor MWDL(t), but it is possible to use the consumed power Pi that is calculated from the consumed power detected by the current detection circuit 14 in FIG. 6. Moreover, it is desirable to use both the consumed power Pw estimated from the weighted mean load factor MWDL(t) and the consumed power Pi that is calculated from the consumed power detected by the current detection circuit 14 and to correct them thereafter.

Figure 9:
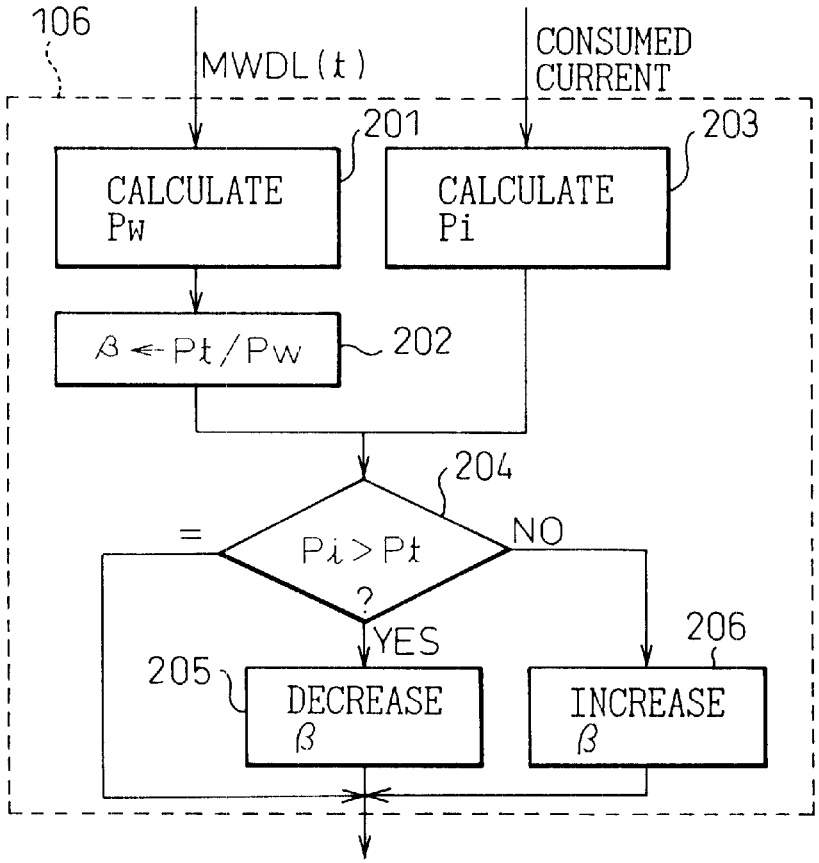
FIG. 9 is a flow chart showing a modified example of the calculating process of the luminance fact or β.

FIG. 9 is a flow chart showing such a modified example of the β process.

In Steps 201 and 202, as with the embodiment described above, Pw and β are calculated. In Step 203, an actual consumed power Pi is calculated from the consumed power detected by the current detection circuit 14 for the display of the previous frame. In Step 204, the calculated consumed power Pi is compared with the preset reference power Pt. If Pi is larger, in Step 205, the luminance β factor is decreased, and on the contrary, if Pi is smaller, in Step 206, the luminance β factor is increased. If Pi=Pt, β is outputted as it is.

Figure 10:
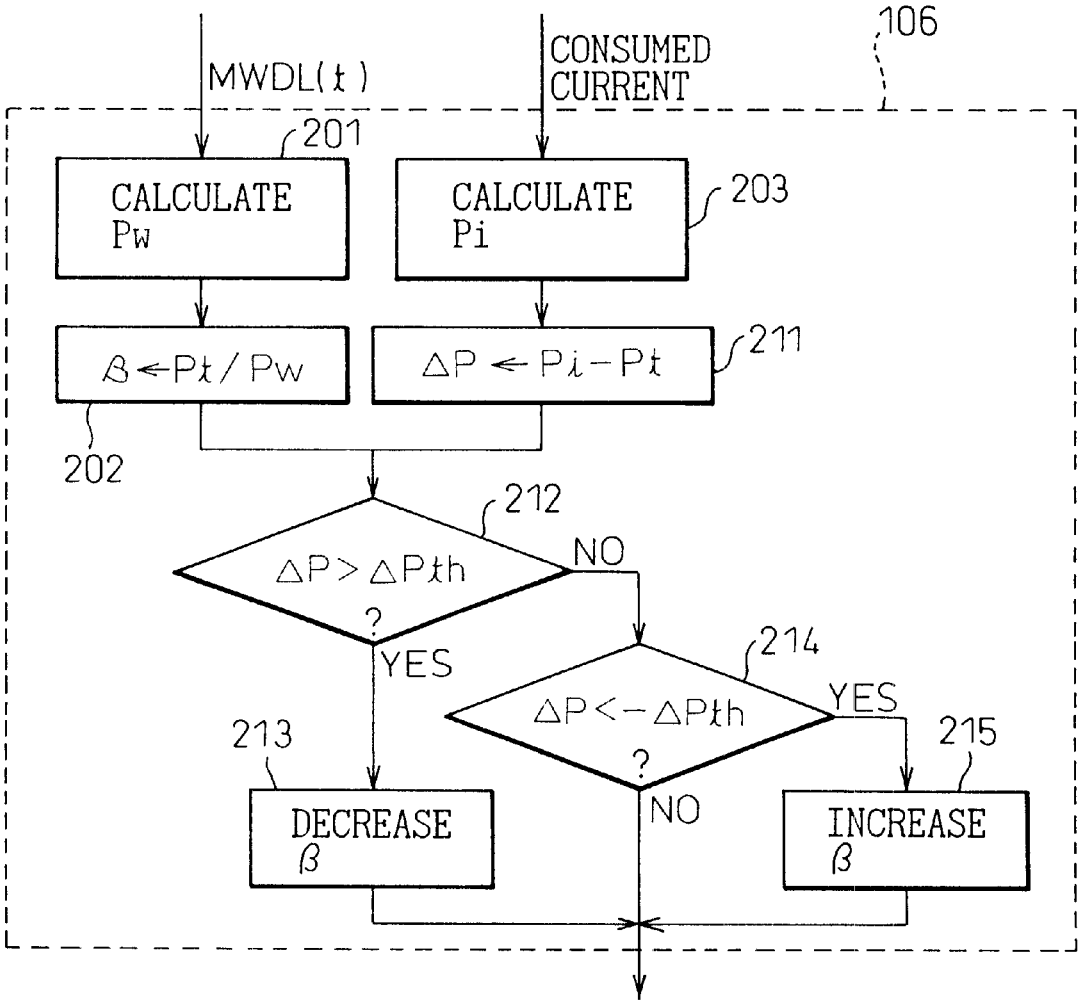
FIG. 10 is a flow chart showing another modified example of calculating process of the luminance factor β.

FIG. 10 is flow chart showing another modified example of the β process.

The processes in Steps 201 to 203 are identical to those same steps shown in FIG. 9. In Step 211, a difference ΔP=Pi−Pt between the actual consumed power Pi and the preset reference power Pt is calculated. In Step 212, ΔP is compared with a preset threshold value ΔPth, and if ΔP is larger, in Step 213, the luminance β factor is decreased and, to the contrary, if ΔP is smaller, in Step 214, ΔP is further compared with −ΔPth, and if ΔP is smaller, the luminance β factor is increased in Step 215 but, if ΔP is not smaller, β is maintained as it is. By using the luminance factor thus obtained, when the consumed power varies slightly, the luminance factor does not change, and therefore, flickering can be reduced.

Figure 11:
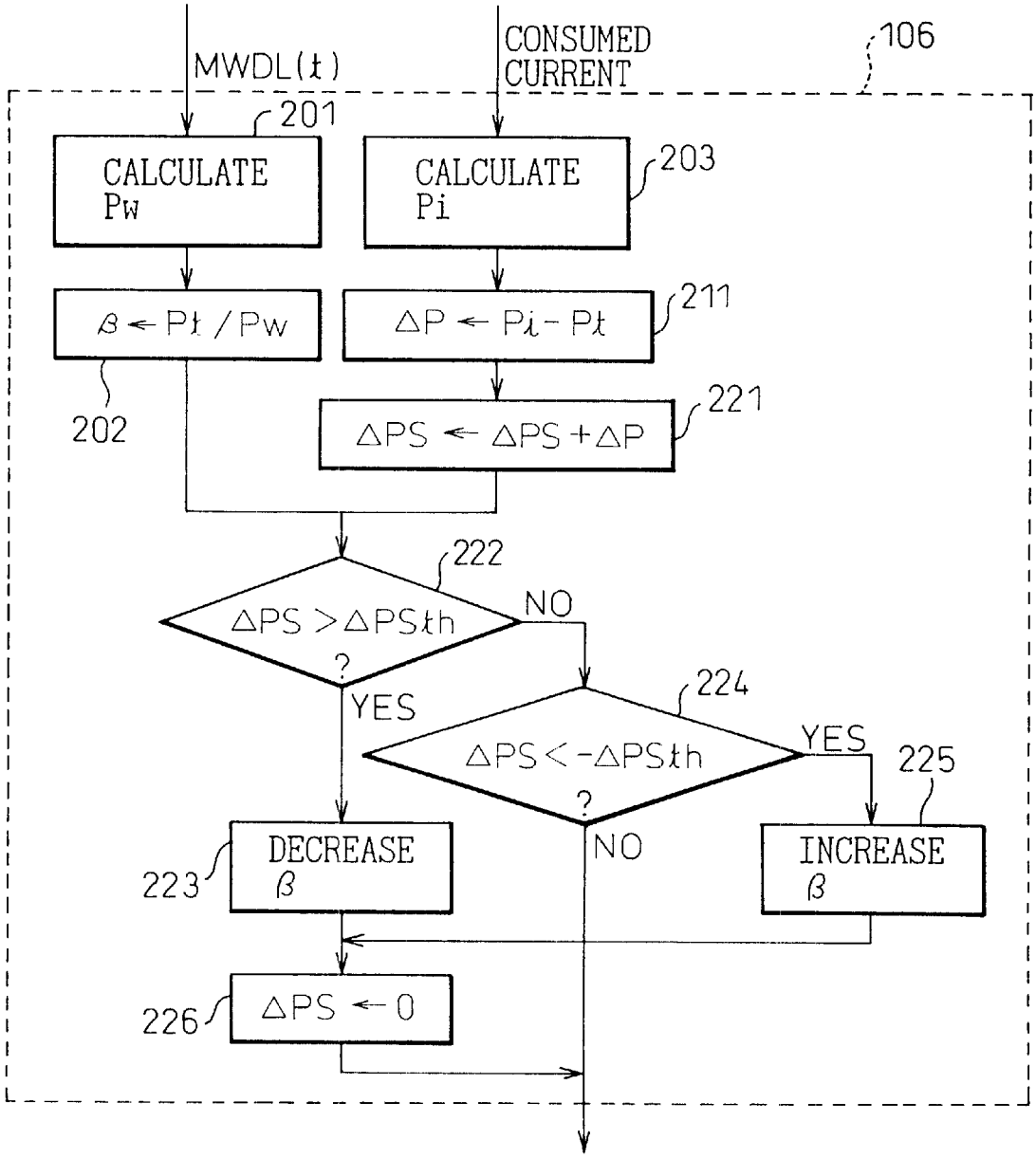
FIG. 11 is a flow chart showing another modified example of the calculating process of the luminance factor β.

FIG. 11 is a further modified example of the β process. The power supply for the unit is buffered by a capacitor or the like, and, for example, in a case where the consumed power alternately repeats an increase and a decrease in every frame, according to the process shown in FIG. 10, the luminance factor β varies in every frame, and flickering cannot be reduced. With a process in FIG. 11, however, such a problem can be solved.

The processes in Steps 201 to 203 and 211 are identical to those in FIG. 10. In Step 221, an integrated value is calculated by adding ΔPS calculated in the current frame to an integrated value of a difference ΔPS between Pi, for the frames up to the previous one, and Pt. In Step 222, ΔPS is compared with a preset threshold value ΔPSth and, if ΔPS is larger, in Step 223, the luminance β factor is decreased, but, if ΔPS is smaller, in Step 224, ΔPS is further compared with −ΔPth, and if ΔPS is smaller, the luminance β factor is increased in Step 225, but, if ΔPS is not smaller, β is maintained as it is. After Steps 223 and 225, ΔPS is reset in Step 226. Through these processes ΔPS is averaged in a plurality of frames, and only when the averaged one is larger, is the luminance β factor changed. With these processes, even when the consumed power is repeatedly increased and decreased, no flickering is generated.

As has been described heretofore, according to the present invention, irrespective of a variation in display load as a whole or in the respective subframes, a PDP unit can be realized in which a display of optimum brightness can be effected without deterioration in gradation display.

What is claimed is:

1. A frame-time sharing type plasma display unit in which a display frame for one screen comprises a plurality of sub-frames, and in which the respective luminance of each sub-frame is determined by a corresponding sustaining pulse number, said plasma display unit comprising;

a frame length calculation circuit calculating a length of one frame from a length of one cycle of a vertical synchronization signal;

a sub-frame condition determination circuit determining a number of sub-frames SFNUM, a respective luminance ratio WSFi of each of said sub-frames and a total sustaining pulse number NSUSmax from the length of said one frame;

a load factor calculation circuit calculating a respective load factor DLi of each of said sub-frames, which is a ratio of a number of display cells that are illuminated to a total number of display cells in the sub-frame, from an external input signal;

a luminance factor calculation circuit determining a maximum display luminance from a consumed power and calculating a luminance factor β; and a sustaining pulse number calculation circuit correcting the luminance drops of said respective sub-frames due to a load based on said total sustaining pulse number, said respective luminance ratios, said luminanace factor and said load factors for said respective sub-frames and calculating a corrected sustaining pulse number CSPi for each of said plurality of sub-frames of each said frame.

2. A plasma display unit as set forth in claim 1, wherein said luminance factor calculation circuit comprises a consumed power calculating circuit calculating said consumed power based on said load factors.

3. A plasma display unit as set forth in claim 2, further comprising a weighted mean load factor calculating circuit calculating a weighted mean load factor MWDL based on said load factors and said respective luminance ratios for said respective plurality of sub-frames of each said frame, wherein said consumed power calculating circuit calculates said consumed power based on said weighted mean load.

4. A plasma display unit as set forth in claim 3, wherein said sustaining pulse number calculation circuit comprises a load factor memory storing said weighted mean load factor, and a load factor variation calculating circuit calculating a difference between said calculated weighted mean load factor and a weighted mean load factor stored in said load factor memory, wherein:

when said difference does not exceed a predetermined threshold value, the sustaining pulse numbers of said plural sub-frames of each said frame are not calculated and the sustaining pulse numbers of respective sub-frames in a previous frame are outputted as sustaining pulse numbers for the sub-frames of the current frame, and when said difference exceeds the predetermined threshold value, calculated sustaining pulse numbers for the respective sub-frames are outputted.

5. A plasma display unit as set forth in claim 1, wherein said luminance factor operation circuit comprises:

a consumed power operation circuit detecting a consumed power of the unit and calculating said consumed power from a value so detected; and a comparison circuit comparing said consumed power with a preset reference power, wherein when said consumed power exceeds said reference power, said luminance factor is decreased and, when said consumed power does not exceed said reference power, said luminance factor is increased.

6. A plasma display unit as set forth in claim 1, wherein said sustaining pulse number calculation circuit calculates the corrected sustaining pulse number CSPi according to the following formula:

$$CSPi=\Sigma(DLi\times WSFi)\times NSUS\max\times WSFi\times\beta/((\Sigma WSFi)^2\times DLi).$$

* * * * *